United States Patent [19]

Fischer

[11] 3,972,431

[45] Aug. 3, 1976

[54] GRAPPLE UNIT FOR LOGGING VEHICLES

[75] Inventor: Robert Louis Fischer, New Lenox, Ill.

[73] Assignee: Caterpillar Tractor Co., Peoria, Ill.

[22] Filed: Feb. 24, 1975

[21] Appl. No.: 552,381

[52] U.S. Cl. ..... 214/147 G; 294/106

[51] Int. Cl.[2] ..... B66C 1/32

[58] Field of Search ..... 214/147 G, 147; 294/106

[56] References Cited

UNITED STATES PATENTS

| | | | |
|---|---|---|---|
| 3,048,288 | 8/1962 | Dwyer | 214/147 G |
| 3,513,998 | 5/1970 | Stone | 214/147 G |
| 3,620,394 | 11/1971 | Symons | 214/147 G |

*Primary Examiner*—Philip Goodman
*Attorney, Agent, or Firm*—Phillips, Moore, Weissenberger, Lempio & Strabala

[57] ABSTRACT

A grapple unit of a type suited for arrangement upon a movable arch of a log skidding vehicle, the grapple unit including a structural plate assembly providing enclosed support for a pair of grapple arms and a hydraulic jack, the grapple arms preferably being operable by a single hydraulic jack through an interconnecting link with the grapple arms closing towards a gripping surface on the structural plate assembly in order to secure logs and the like of varying sizes.

4 Claims, 4 Drawing Figures

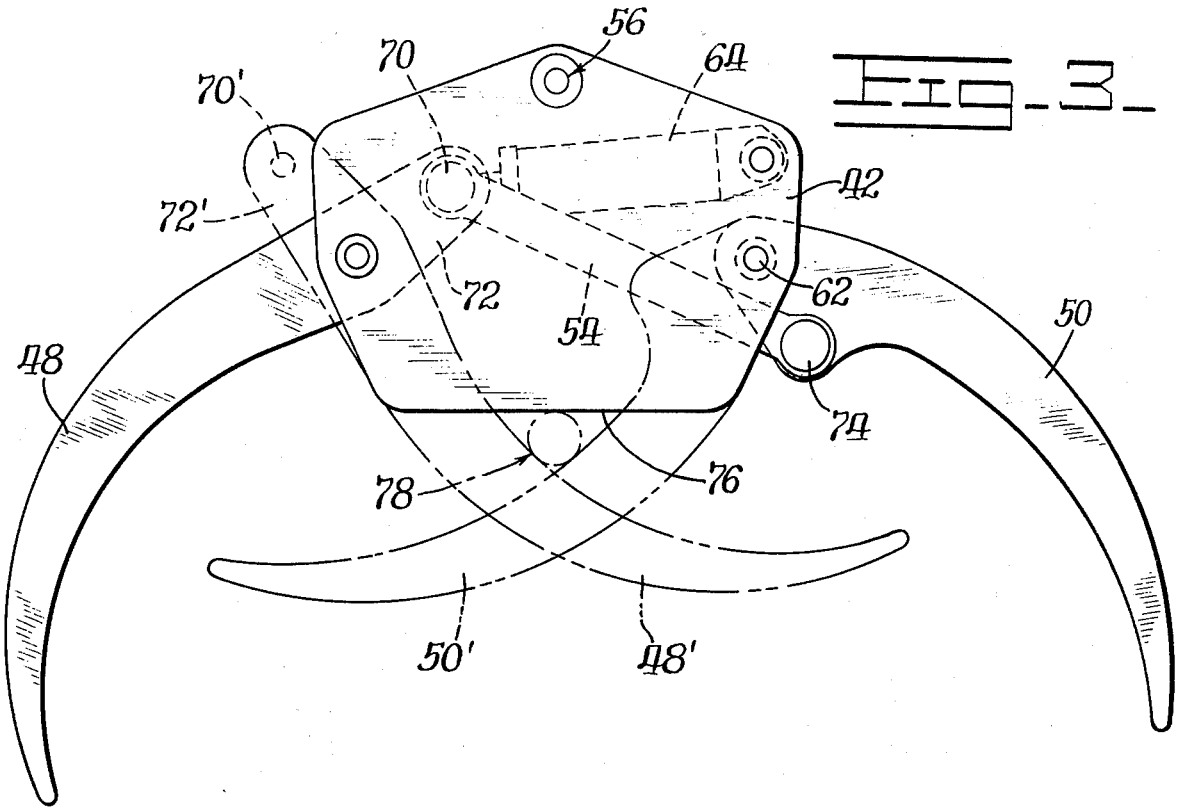
Fig. 3
Fig. 4
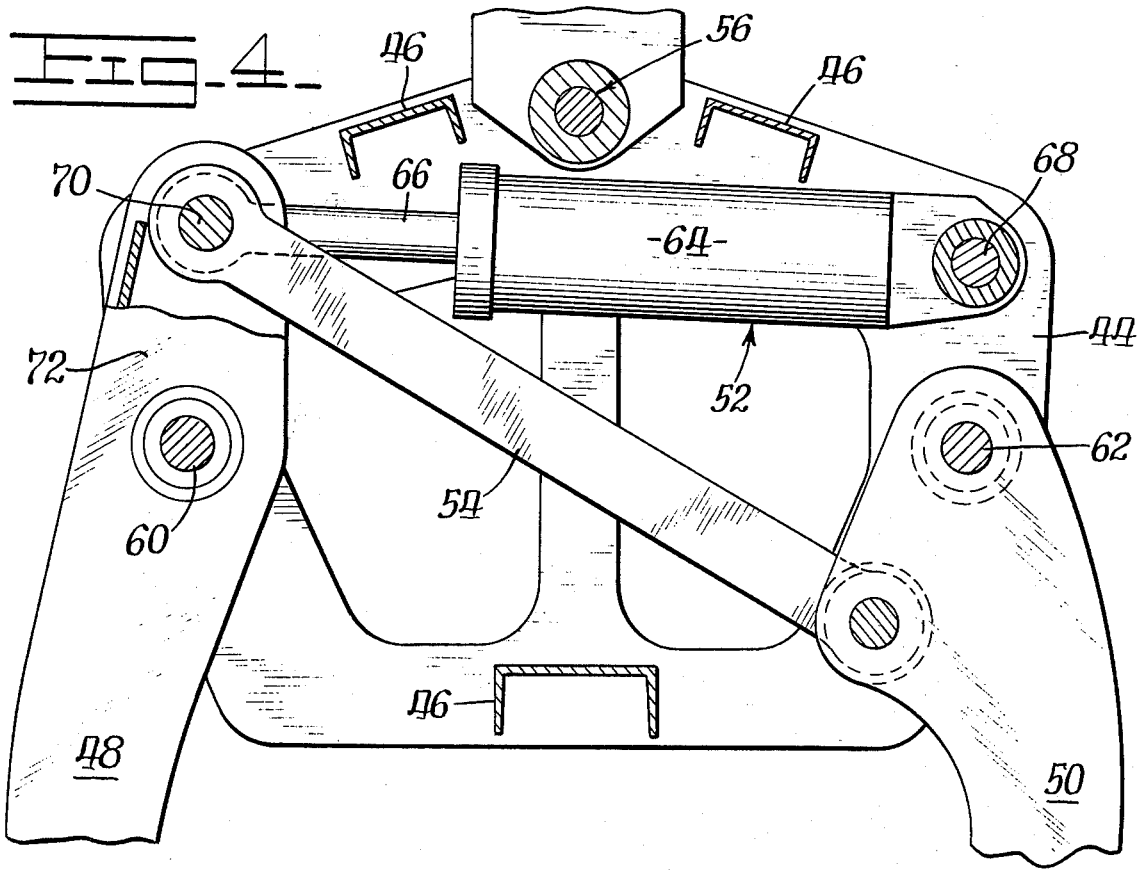

GRAPPLE UNIT FOR LOGGING VEHICLES

BACKGROUND OF THE INVENTION

The present invention relates to a grapple unit and more particularly to such a unit arranged upon one end of a logging machine for securing logs and the like of varying sizes.

It is well known to provide logging vehicles or skidders with a grapple unit at one end for securing trees or logs which are to be moved by the vehicle. Since the vehicle may be employed to move very large trees or even a number of trees at one time, it is necessary to design the grapple unit for continued operation under very substantial stresses. Also, in order to assure reliable and continued operation, it is necessary to prevent the grapple unit from being damaged by engagement with the logs it is intended to engage.

A skidder vehicle of the type contemplated by the present invention may be used primarily for conveying felled trees to a mill or other processing site. On the other hand, the trees may be delimbed and cut into logs of selected length or otherwised processed prior to being moved by the skidder vehicle. Since the skidder vehicles operate under widely varying conditions and commonly encounter rough terrain, it is necessary to insure that logs or trees of varying sizes be firmly secured by the grapple unit during conveyance by the skidder vehicle.

SUMMARY OF THE INVENTION

Accordingly, it is an object of the present invention to provide a grapple unit capable of effectively securing logs and the like of varying sizes.

It is another object of the invention to provide a grapple unit wherein a structural plate assembly provides a protective enclosure for moving portions of the grapple unit.

It is yet another object of the invention to provide a grapple unit of the type referred to above wherein the structural plate assembly also provides a gripping surface or edge towards which the grapple arms are movable in order to secure loads of varying sizes.

Additional objects and advantages of the invention are made apparent in the following description having reference to the accompanying drawings.

DESCRIPTION OF THE DRAWINGS

FIG. 3 is an additional view of the grapple unit illustrating movement of its grapple arms relative to a gripping edge provided by a structural plate assembly.

FIG. 4 is an enlarged, fragmentary view, with parts in section, illustrating the manner of interconnection between the grapple arms, the structural plate assembly and a hydraulic jack.

DESCRIPTION OF THE PREFERRED EMBODIMENT

Figure 1:
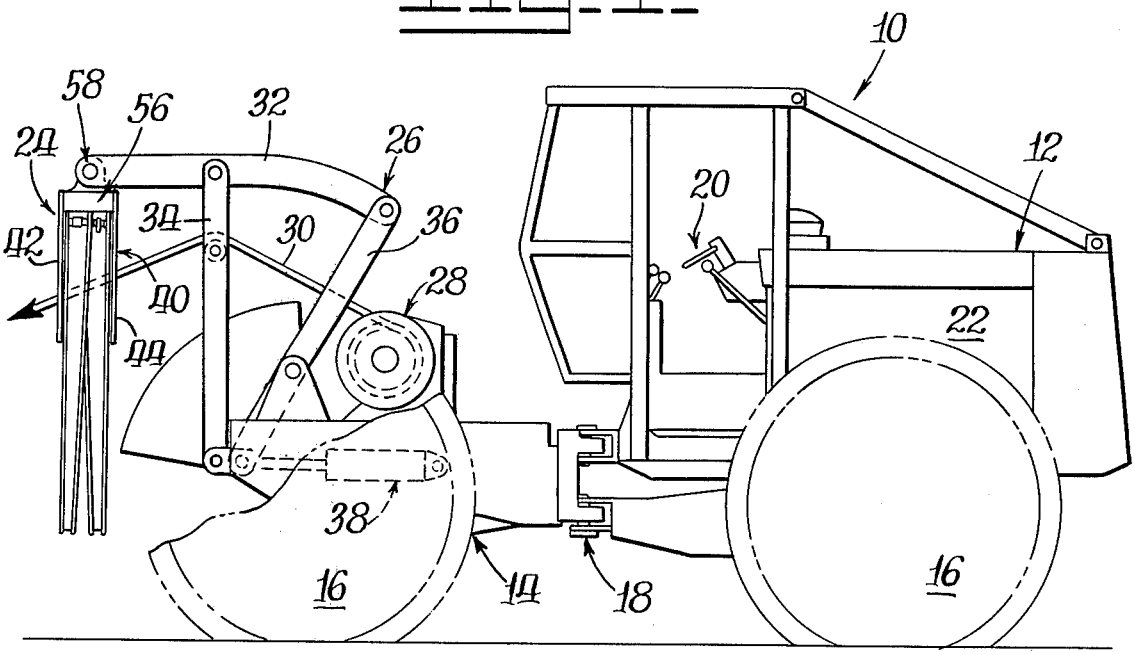
FIG. 1 is a side view in elevation of a log skidding vehicle including a grapple unit constructed according to the present invention.
Figure 2:
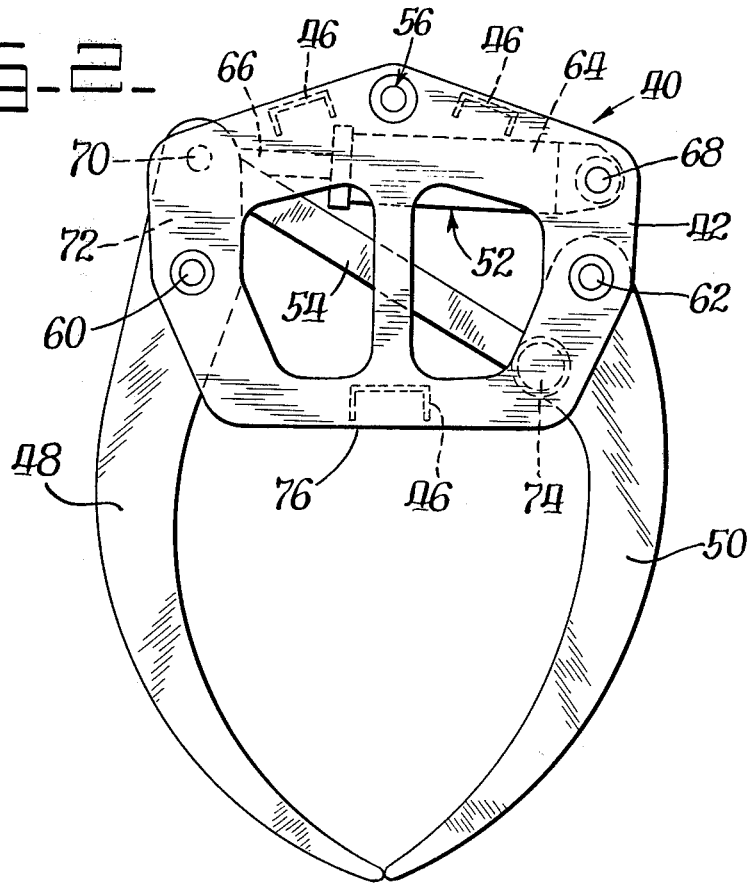
FIG. 2 is an enlarged view of the grapple unit itself.

The present invention is particularly directed toward a grapple unit of the type best illustrated by FIGS. 2–4. However, the grapple unit is contemplated for use with a log skidder vehicle of the type illustrated in FIG. 1. The grapple unit of the present invention is particularly contemplated as providing a relatively simple mechanism effective for handling very substantial loads of widely varying sizes while assuring protection for the operating components of the grapple unit.

The grapple unit is particularly contemplated as including a single motor means or hydraulic jack for controlling movement of both grapple arms. This feature, in itself, is known in the prior art as may be seen by reference, for example, to U.S. Pats. 2,903,294 and 3,620,394. However, unlike those references, the grapple unit of the present invention provides a number of additional novel advantages, as summarized above and described in substantially greater detail below.

Referring now to FIG. 1, a log skidding vehicle indicated at 10 includes frame sections 12 and 14 each supported by ground wheels 16 and coupled together in articulated fashion along an axis indicated at 18. Preferably, an operator station 20 and a prime mover or engine 22 are arranged upon one of the frame sections, for example that indicated at 12, while the grapple unit of the present invention is movably supported at one end of the vehicle by the other frame section 14.

The grapple unit, indicated at 24, is supported by means of a movable arch structure 26 which also cooperates with a winch unit indicated at 28. It may be seen in FIG. 1 that the winch unit 28 includes a line or cable 30 which is trained over a portion of the arch structure 26 for engaging a load to be towed by the vehicle. Details of the arch structure 26 are the subject of a copending patent application entitled: MOVABLE ARCH STRUCTURE FOR SKIDDER VEHICLES, filed Mar. 3, 1975, as Application Ser. No. 554,936, having a common Assignee with the present invention.

For purposes of the present invention, it is sufficient to understand that the arch structure 26 includes a beam 32 which is movably mounted upon the vehicular section 14 by means of a pair of pivotable links or levers 34 and 36 which are controlled by a hydraulic jack generally indicated at 38.

The arrangement of components within the grapple unit 24 is best illustrated by FIG. 2 while its manner of operation is illustrated by FIG. 3 and the particular interconnection between components of the grapple unit is best seen in FIG. 4. The grapple unit includes a structural plate assembly 40 which, among other functions, serves to protect various moving parts and interconnections for the grapple unit. The structural plate assembly 40 includes a pair of plates 42 and 44 (also see FIG. 1) which are secured together in parallel, spaced-apart relation by means of a plurality of structural beam indicated at 46.

Additional components for the grapple unit 24 include a pair of grapple arms 48 and 50, a hydraulic jack 52 and an interconnecting link 54 by which the single jack 52 is adapted to position both grapple arms 48 and 50. As will be described in greater detail below, the structural plates 42 and 44 provide pivotable support for each of these elements and while also defining an enclosed region for containing and safeguarding both the jack 52 and the link 54 from damage through contact with trees or other material being handled by the grapple arms.

A pivot assembly 56 arranged between the plates 42 and 44 permits connection of the entire grapple unit 24 to the beam 32. Referring also to FIG. 1, it may be seen that an additional pivot assembly 58 is provided to permit biaxial pivoting of the grapple unit 24 relative to the beam 32.

The grapple arms 48 and 50 are arranged between the plates 42, 44 and movably secured thereto by means of respective pivot connections 60 and 62.

The hydraulic jack 52 includes a cylinder 64 and an extendable rod 66. The cylinder 64 is arranged between the plates 42, 44, and pivotably secured thereto as indicated at 68. Similarly, the rod 66 is pivotably connected at 70 to a bracket portion 72 forming an integral portion of the grapple arm 48 and extending beyond the pivot point 60.

The interconnecting link 54 is also secured at one end to both the bracket 72 and the rod 66 by means of the pivot connection 70. The opposite end of the interconnecting link 54 is pivotably connected to the other grapple arm 50 at 74. It may be seen by reference to FIG. 2 that the pivot connection 74 and the pivot connection 70 are arranged upon opposite sides of the pivot connections 60 and 62 for the grapple arms 48 and 50. Through this arrangement, retraction of the single jack 52 serves to move both grapple arms 48 and 50 apart from each other toward an open position illustrated by solid lines in FIG. 3. Extension of the jack 52 serves to close both grapple arms 48 and 50 toward a closed position illustrated by broken lines in FIG. 3 at 48' and 50'.

In addition to providing a support for the various movable portions of the grapple unit and forming an enclosed region for protecting those same components, one or both of the plates 42 and 44 form a gripping surface as indicated at 76 for cooperation with the grapple arms to secure loads of varying size. As may be best seen by reference to FIGS. 2–4, the grapple arms 48 and 50 extend outwardly adjacent the gripping surface 76. Referring particularly to FIG. 3, the grapple arms 48 and 50 are moved both apart from each other and away from the gripping surface 76 by retraction of the jack 52. Upon extension of the jack 52, the grapple arms 48 and 50 are moved both toward each other and toward the gripping surface 76 so that logs of varying sizes may be securely gripped therebetween. For example, a very small log is illustrated in FIG. 3 at 78 as being secured between the gripping surface or edge 76 as well as both of the grapple arms 48 and 50. It will be particularly obvious from reference to FIG. 3 that the gripping edge 76 together with the grapple arms 48 and 50 would be equally effective to securely grip logs having substantially greater diameters.

Accordingly, a grapple unit constructed according to the preceding description is particularly adapted for example on a log skidding vehicle as illustrated in FIG. 1, to provide a relatively simple, reliable grapple unit for securely engaging loads of varying sizes.

I claim:

1. A logging machine comprising a vehicle, arch means movably arranged on one end of the vehicle, and a grapple unit supported by the arch means, the grapple unit including a structural plate assembly having a pair of plates secured together in spaced apart relation to form an enclosed region therebetween, the structural plate assembly being secured to the arch means on one side while forming a gripping edge on a generally opposite side, a pair of grapple arms extending outwardly from the enclosed region of the structural plate assembly adjacent the gripping edge, a single motor means arranged within the enclosed region of the plate assembly and in protected relationship between the plates thereof, and means interconnecting the motor means with the two grapple arms and pivotably anchoring the motor mean-s and grapple arms on the structural plate assembly so that operation of the motor means causes the grapple arms to open away from each other and to close toward each other and toward the gripping edge to secure logs and the like of varying sizes.

2. The logging machine of claim 1 wherein the motor means is a hydraulic jack.

3. The logging machine of claim 1 wherein the means interconnecting the motor means with the two grapple arms includes a pivot connection between the motor means and one of the grapple arms and an interconnecting link connected with the respective grapple arms on opposite sides of their pivotable connections with the structural plate assembly.

4. The logging machine of claim 3 wherein the motor means comprises a hydraulic jack.

* * * * *